United States Patent [19]

Kelly et al.

[11] 4,155,111

[45] May 15, 1979

[54] LATCH AND HINGE ASSEMBLY FOR REFRACTOR PANEL IN LUMINAIRE

[75] Inventors: James P. Kelly, Cudahy; Donald Wandler, South Milwaukee, both of Wis.

[73] Assignee: McGraw-Edison Company, Elgin, Ill.

[21] Appl. No.: 829,217

[22] Filed: Aug. 31, 1977

[51] Int. Cl.[2] ..... F21V 17/00

[52] U.S. Cl. ..... 362/374; 362/282; 362/307; 362/365; 362/375

[58] Field of Search ..... 362/362, 365, 366, 374, 362/307, 375; 24/238 NP; 292/46

[56] References Cited

U.S. PATENT DOCUMENTS

| | | | |
|---|---|---|---|
| 2,936,189 | 5/1960 | Pearson | 292/46 |
| 3,342,986 | 9/1967 | Jablonski et al. | 362/307 |
| 3,380,770 | 4/1968 | Risley | 362/375 |
| 3,524,051 | 8/1970 | Baldwin et al. | 362/307 |
| 3,604,921 | 9/1971 | Wood et al. | 362/374 |
| 3,928,758 | 12/1975 | Ostein et al. | 362/362 |
| 3,943,355 | 3/1976 | Lundy | 362/374 |
| 4,019,044 | 4/1977 | Kelly et al. | 362/362 |

*Primary Examiner*—Benjamin R. Padgett
*Assistant Examiner*—J. L. Barr
*Attorney, Agent, or Firm*—Jon C. Gealow; Thomas E. McDonald; Bruce R. Mansfield

[57] ABSTRACT

A latch and hinge assembly for releasably securing the refractor panel of a luminaire on the luminaire housing at the open end thereof includes first and second pairs of spring loaded plunger rods mounted at non-intersecting ends of the frame of the refractor panel, each such pair of rods extending along a common axis parallel to the edge of the corresponding end of the frame. The rod ends which normally extend outwardly from the frame at opposite ends thereof are received in aligned apertures in corresponding walls of the luminaire housing to attach the refractor panel thereto. Manually operated tabs for retracting the plunger rods of the first rod pair extend from a first surface of the panel facing the interior of the housing while the tabs for retracting the plunger rods of the second rod pair extend from the opposite surface of the panel facing the exterior of the housing. The location of the manually operated retracting tabs prevents the release of two rods not of the same pair. The first pair of plunger rods serves as a hinge about which the panel may be pivoted and the second pair of plunger rods serves as a latch which is releasable for obtaining access to the interior of the luminaire housing. A preferred embodiment of the luminaire and refractor panel according to the invention has the shape of an equilateral polygon so that the refractor panel can be oriented in various preselected ways with respect to the housing for ease in maintenance of the luminaire.

5 Claims, 5 Drawing Figures

LATCH AND HINGE ASSEMBLY FOR REFRACTOR PANEL IN LUMINAIRE

BACKGROUND OF THE INVENTION

This invention relates generally to luminaires and more particularly to latch and hinge mechanisms for fastening refractor and the like panels thereof to the housing of the luminaire.

Various types of mechanisms have been used to fasten refractor and the like panels to a luminaire housing. These mechanisms must provide an adequate seal to minimize the entry of dust and moisture into the housing as well as to be readily and quickly releasable to provide access to the housing interior for maintenance purposes.

A mechanism which meets the last-mentioned requirements and in addition not only performs the function of latching but serves as a hinge so that upon release the refractor panel can be swung away from the luminaire housing at one end thereof but not be completely removed therefrom, if desired, is shown in U.S. Pat. No. 3,943,355.

The latch and hinge mechanism of the last-mentioned U.S. patent comprises four spring loaded plunger rods or pins which are mounted within recesses or channels defined at the four corners of the frame portion of the refractor panel. The plunger rods operate in pairs such that a first pair is on a common axis along one edge of the frame while the other pair is on a second common axis on the opposite edge of the frame The rods or pins are biased outwardly from the corners of the frame and are manually retractable into the frame. Upon placing the frame into a complementarily shaped opening at one end of the luminaire housing, the rods are released and enter aligned apertures provided in the side walls of the luminaire housing to hold the refractor panel thereto. If desired, either pair of the rods can be released so that a corresponding end of the refractor panel may be swung away from the housing and about the opposite pair of rods. Also, if desired, all four plunger rods may be released for removal of the refractor panel from the luminaire housing.

In the case of the above-described latch and hinge mechanism, tabs or the like portions of the plunger rod which can be manually manipulated to move the plunger rods into a retracted position in the frame, are all located on the outside or exposed surface of the refractor panel and as such are all accessible when the panel is mounted on the luminaire housing. Accordingly, one is able to release both pairs of plunger rods from the outside of the luminaire. In such case, it is also possible that one repairing a luminaire of the type described may inadvertently release two plunger rods which are not of the same pair. If this should occur, it is quite likely that the refractor panel would fall from the luminaire housing and could thereby become damaged. Furthermore, if the luminaire were located in an elevated position, on a post or at the side of a building, for example, the improper release of the refractor panel could cause injury to persons below or to the person making the repairs.

In addition to the above, it appears from the description of the latch and hinge assembly of the U.S. Pat. No. 3,943,355 that the refractor panel is designed for mounting on a luminaire housing in one position only, thereby permitting the refractor panel to be swung away from the housing only at either of two opposite ends thereof.

In some cases where the luminaire is positioned so that it would be more easily accessible for repair if the refractor panel could be swung away at a side of the luminaire housing other than such two opposite ends, the arrangement of the U.S. Pat. No. 3,943,355 would not be suitable.

SUMMARY OF THE INVENTION

Accordingly, it is a primary object of the present invention to provide a luminaire having a latch and hinge assembly for the refractor panel thereof of the type shown in U.S. Pat. No 3,943,355, which assembly has been improved to overcome the drawbacks described heretofore.

It is a further object of the present invention to provide in a luminaire, a latch and hinge assembly for the refractor panel of the above-described type which is easily operated, yet safe in that two plunger rods each of which is of a different pair, cannot be operated together.

It is still another object of the present invention to provide a latch and hinge assembly of the above-described type for use with a refractor panel of polygonal shape and which is symmetrical, such frame designed for receipt in a complementarily shaped symmetrical luminaire housing whereby the refractor panel can be swung away from the luminaire housing at any wall thereof which has been preselected.

Briefly, a preferred embodiment of the latch and hinge assembly according to the invention comprises first and second pairs of plunger rods or pins which are mounted at non-intersecting ends of the frame of a refractor panel of a luminaire. A first one of the pairs of the plunger rods is mounted above a first edge of the frame on a common axis, with the rods normally extending from opposite ends of the frame edge. The other pair of plunger rods is mounted along an a first edge of the frame on a common axis, with the rods normally extending from opposite ends of the frame edge. The other pair of plunger rods is mounted along an opposite edge of the frame not intersecting the first edge, on a common axis. Tabs provided on the plunger rods of the first pair for manipulating the rods to a retracted position, are accessible only from a first surface of the refractor panel. Tabs provided on the plunger rods of the second pair for manipulation thereof are accessible only from the opposite surface of the refractor panel. Upon mounting the refractor panel on the luminaire housing, the plunger rods whose tabs are accessible from the surface of the panel facing the interior of the luminaire housing are employed as hinges about which the refractor panel may be pivoted and those plunger rods whose tabs are accessible from the outer surface of the frame are used to lock the refractor panel to the luminaire housing and are releasable to obtain access to the interior of the housing. With this arrangement, the first-mentioned pair of plunger rods cannot be released while the frame is in place on the housing, thus avoiding the problem of releasing two rods not of the same pair.

Furthermore, the luminaire in which refractor panel including the latch and hinge assembly according to the invention is employed is of a polygonal shape preferably, but not limited to having an even number of walls, is symmetrical and includes apertures for receiving the plunger rods in both corners of all walls thereof. As such, the refractor frame can be mounted for swing-away release from any preselected side wall of the luminaire housing. This provides good access for repair, etc., regardless of the location of the luminaire.

DETAILED DESCRIPTION OF THE DRAWINGS

Figure 1:
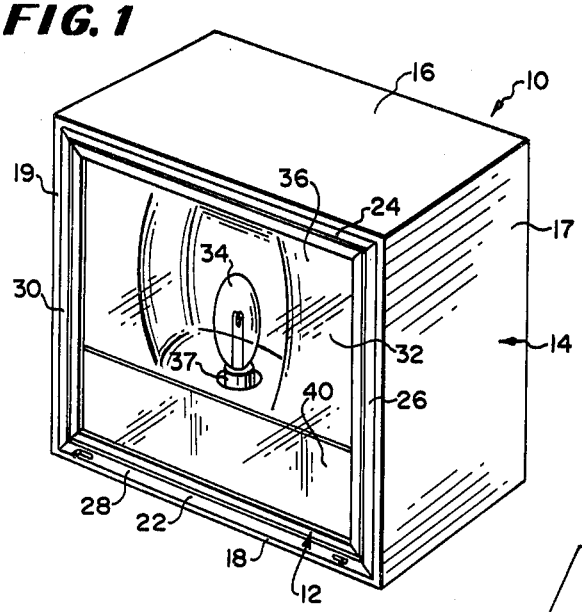
FIG. 1 is a perspective view of a preferred embodiment of a luminaire including a latch and hinge assembly for securing the refractor panel thereof to the luminaire housing according to the invention.
Figure 3:
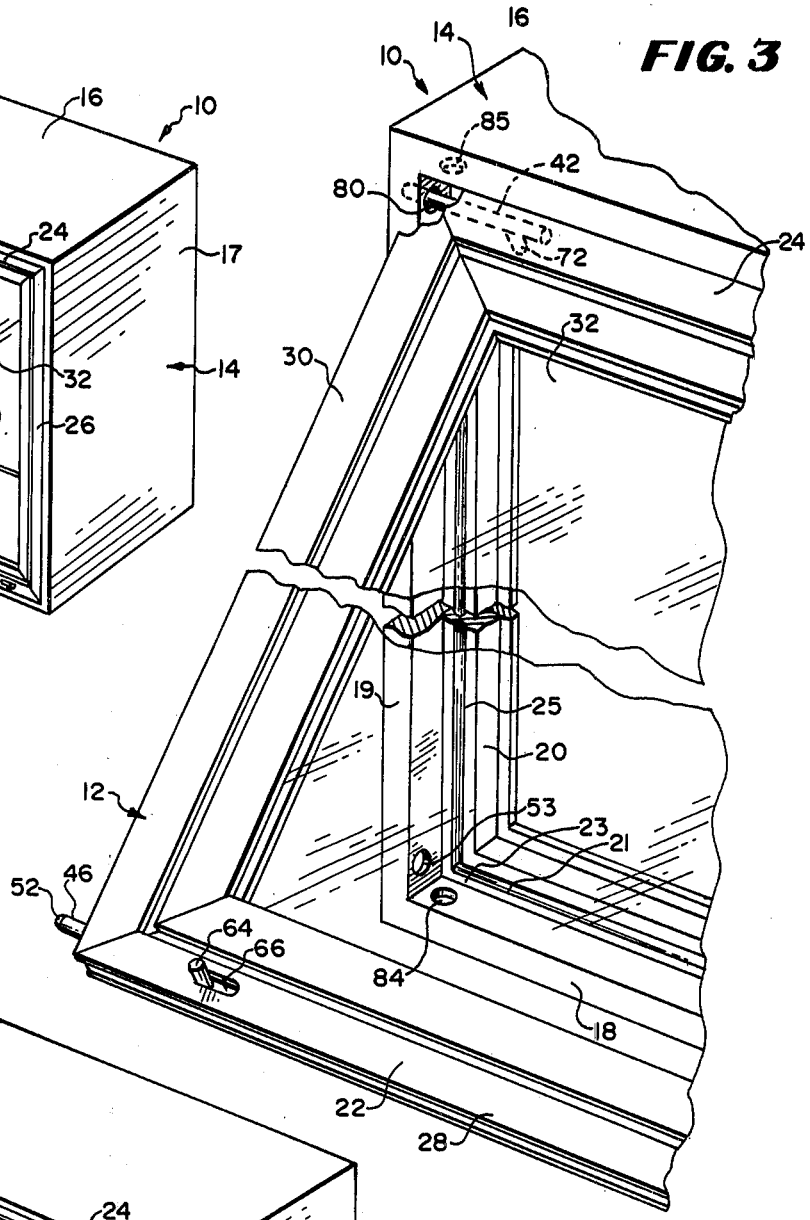
FIG. 3 is an enlarged, fragmentary, perspective view of the luminaire of FIGS. 1 and 2 illustrating in greater detail the latch and hinge assembly of the invention.
Figure 2:
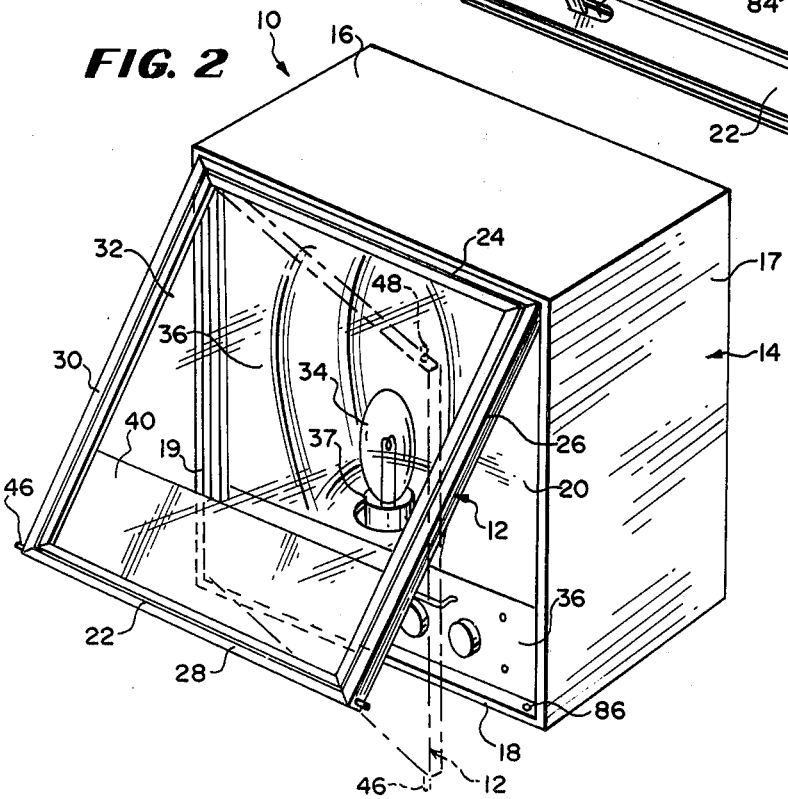
FIG. 2 is a perspective view of a luminaire of FIG. 1 illustrating the operation of thelatch and hinge assembly according to the invention; the latch

Referring now to the drawings in greater detail wherein like numerals have been employed throughout the various views to designate similar components, there is illustrated in FIGS. 1–3 a preferred embodiment of a luminaire 10 including a latch and hinge assembly for removably securing a refractor panel 12 on the luminaire housing 14 according to the invention.

In the embodiment shown, the luminaire housing 14 comprises side walls 16, 17, 18, 19. The side walls are of metallic construction, of equal length and joined at the ends thereof to form a housing having a square cross section. A rear wall (now shown) is attached to the side walls to complete the housing. The housing has a front opening 20 defined by the side walls. The opening is covered by a refractor panel 12 received in the opening. Each of the walls includes a lip, such as 23 (FIG. 3), formed thereon which together form a rim 25 about the open end of the housing spaced from the free ends of walls 16, 17, 18, 19. A rubber or the like gasket 21 is fastened to rim 25 around the opening against which the inner surface of the refractor panel is pressed to minimize the quantity of dust and foreign material entering the housing.

The refractor panel 12 includes an outer frame 22 fabricated of aluminum of like material and comprising side walls 24, 26, 28, 30, of equal length joined together at the ends thereof. The frame is dimensioned complementarily to the front opening 20 on the housing for receipt therein. A central glass 52 is mounted in frame 22 of the refractor panel to permit light from a lamp 34 mounted in the luminaire housing to radiate outwardly therefrom. A reflector 36 is mounted in housing 14 adjacent lamp 34 and serves to enhance the illumination provided by the lamp.

Below the lamp and reflector in the housing as seen in FIG. 2, there is provided a tray 36 which carries the electrical components including the lamp socket 37, for energizing lamp 34. Such a luminaire is described in greater detail in U.S. Pat. No. 4,019,044 assigned to the same assignee as the instant invention.

Figure 4:
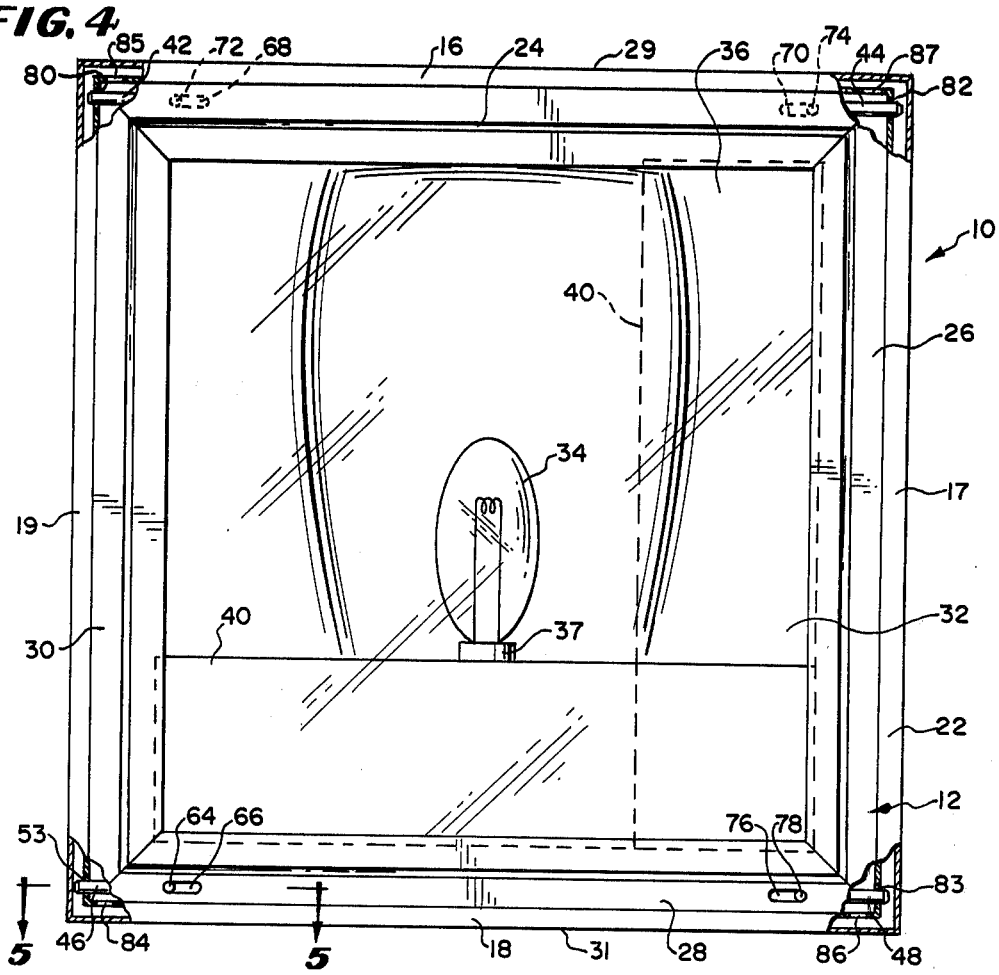
FIG. 4 is a partially broken away front view of the luminaire of FIGS. 1–3 illustrating the function of the spring loaded plunger rods of the latch and hinge assembly according to the invention.

An opaque cover plate 40 is removably mounted between the side walls of frame 22 over the cover glass of the refractor panel to block from view the component tray 36 described heretofore. The position of cover plate 40 on panel 12, as seen in FIG. 4 of the drawings, may be changed to cover the electrical component tray regardless of the orientation of the reflector panel on the luminaire housing.

Figure 5:
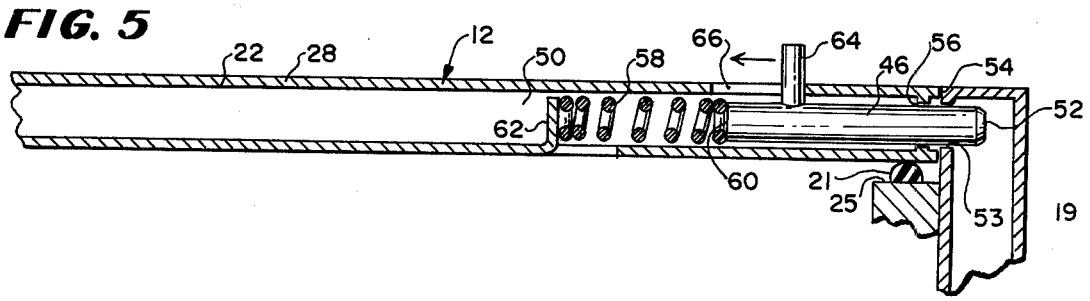
FIG. 5 is a cross sectional view of the luminaire of FIG. 4 taken along the line 5—5.

The latch and hinge assembly according to the invention is provided for removably mounting the refractor panel 12 in the front opening of the luminaire housing. The assembly likewise permits the panel to be pivoted about one end thereof for access to the housing interior while maintaining the panel secure at an opposite end with respect to the housing. The assembly includes a first pair of plunger rods or pins 42, 44 (FIG. 4) mounted within a first wall 24 of the frame 22 of the refractor panel along a common axis parallel to edge 29 of the frame and a second pair of plunger rods 46, 48 (FIG. 4) mounted within a second, non-intersecting wall 28 of the frame 22 opposite from wall 24, along a common axis parallel to edge 31 of the frame. The rods are mounted for sliding movement in a channel defined in the side walls of the frame 22. A detailed description of the plunger rod mounting will be given using rod 46 as an example as shown in FIG. 5 of the drawings.

The plunger rod 46 is slidable in channel 50 defined in wall 28 of the frame 22. The channel is formed parallel to edge 31 of the frame. The free end 52 of rod 46 extends outwardly from the edge 54 of the frame through an aperture 56 provided therein. A coil spring 58 is located in the channel between the opposite end 60 of the rod and an ear 62 bent into the channel. Accordingly, the rod 56 is biased so that end 52 thereof is normally extended outwardly of the edge 54 of the frame. While the refractor panel is in position in the front opening of the housing, end 52 of the plunger rod is received in an aperture, such as 53, provided in the side wall 19 of the housing (see FIG. 3). A tab 64 extending from the body of the plunger rod at right angles thereto protrudes through a slotted aperture 66 defined in wall 28 of the frame. Tab 64 is provided for manually moving rod 46 against the force of biasing spring 58 so that end 52 of the rod is retracted in the channel 50.

In the case of the first pair of plunger rods 42, 44, the slotted apertures 68, 70 through which tabs 72, 74, respectively, pass outwardly of the frame of the refractor panel, while the slotted apertures 66, 76 through which the tabs 64, 78, of plunger rods 46, 48, respectively, pass, are located on the opposite surface of the frame. The location and accessibility of the plunger rod tabs has been selected as described so that the first pair of plunger rods is retractable only from the interior of the housing and only after the second pair of plunger rods has been released from the exterior of the housing. The reason for the placement of the plunger rod retracting tabs as described will be explained in greater detail hereinafter.

When mounting refractor panel 12 on the luminaire housing in opening 20 thereof, a first edge 29 of the frame 22 of the refractor panel including plunger rods 42, 44, is inserted into a selected end of the housing opening 20 so that the frame wall including the rods is adjacent and parallel to a corresponding side wall of the housing. The side wall of the frame selected must have the plunger tabs extending toward the interior of the housing.

Referring to FIG. 3, in the case of the luminaire embodiment shown, plunger rods 42, 44 are positioned to face the interior of the housing when the refractor panel 12 is oriented as shown. The tabs 72, 74 are manually moved to retract the plunger rods. Wall 24 of the frame is thereafter inserted into the opening directly adjacent wall 16 of the housing so that the plunger rods are aligned with apertures such as 80, 82, see FIG. 4, in the adjacent side walls 19, 17, respectively, of the housing. Once aligned, tabs 72, 74 are released to permit the ends of the plunger rods to be received in respective apertures 80, 82. At this time, plunger rods 42, 44, secure one end of the refractor panel 12 to the housing and serve as a hinge for the panel as the latter is pivotal thereabout.

To completely secure the panel on the luminaire housing in opening 20, tabs 64, 78 of the second pair of plunger rods 46, 48, respectively, are manually moved to retract the rods into the frame wall 28. In this case the tabs 64, 78 are accessible only from the exterior surface of the frame 22.

Once the plunger rods are retracted, the refractor panel is pivoted about the rods 42, 44 so that the opposite end 31 of the frame at wall 28 is received in housing opening 20 and is positioned adjacent housing wall 18. Thereafter, the plunger rods are permitted to be extended so that the ends of the rods are received in aligned apertures 53, 83, in housing walls 19, 17, respectively.

Because the luminaire housing 14 and refractor panel 12 are symmetrical, the panel can be inserted into opening 20 of the housing in various orientations. A second orientation of the panel is illustrated in dotted lines in FIG. 2. In that case, the plunger rods 42, 44 are received in opposing apertures 84, 85 in walls 16, 18 respectively (FIGS. 3 and 4). Plunger rods 46, 48 of the second plunger rod pair are received in apertures 86, 87, respectively (FIG. 4). Accordingly, the refractor panel can be pivoted about plunger rods 42, 44 as shown in FIG. 3. If it were desired to pivot the panel about the opposite end of the luminaire housing, the panel would be reversed so that plunger rods 42, 44 are received in apertures 86, 87 of the housing walls 16, 18 respectively.

As can be seen from the above description, locating the plunger rod retracting tabs of the first pair of rods on one surface of the refractor panel and the tabs of the second pair of rods on the opposite surface of the panel prevents one from releasing two plunger rods not of the same pair. Accordingly, injury to the operator or to persons in the vicinity of the luminaire due to the complete inadvertent release of the refractor panel, is avoided.

While all of the plunger rods 42, 44, 46, 48, of the embodiment of the luminaire shown are spring biased and are retractable, it is possible to provide only one of the interiorly accessible rods with a retracting capability while the other rod can be made rigid, extending permanently outwardly of the panel frame. This arrangement is possible since the rigid rod may be inserted initially into a corresponding aperture in the housing wall and thereafter the retractable rod of the pair can be inserted into its corresponding aperture. Both of the plunger rods accessible from the exterior of the luminaire must, however, be of the retractable variety.

While the embodiment of the luminaire shown is foursided, luminaires having polygonal shapes with a number of housing walls in excess of four can also employ the latch and hinge assembly according to the invention and can provide varying orientations of the refractor panel thereon so long as the polygon is symmetrical. It should be understood that the invention is not limited to the particular embodiment shown and suggested herein since many modifications can be made. It is therefore contemplated to cover by the present application any and all such modifications as fall within the true spirit and scope of the appended claims.

We claim:

1. A luminaire comprising a housing having a polygonal shape including at least four side walls joined at the ends thereof to define an interior, one end of said housing being open, a panel having a frame shaped complementarily to that of the open end of said housing and mountable therein, said frame including a plurality of walls equal in number to that of said housing and joined together at the ends thereof, and a latch and hinge assembly provided for removably mounting said panel in said housing opening, said latch and hinge arrangement including two pairs of rods, a first pair being mounted in a first wall of said frame along a common axis so that the ends of the rods extend outwardly from opposite ends thereof and a second pair being mounted in a second wall of said frame not intersecting and opposite from said first wall along a common axis and extending outwardly from opposite ends thereof, at least one of a first pair of said rods and both of said second pair of said rods being spring biased, each of said spring biased rods including a tab for manually retracting said rod against said biasing force into a respective wall of said frame, said housing defining holes at opposite ends of at least two opposing walls thereof adjacent said open end for receipt of said first and second pairs of rods, respectively, whereby said panel is mountable on said housing in said open end thereof, said tab of said one spring biased rod of said first rod pair being accessible only from the surface of said panel facing the interior of said housing and the tabs of the second rod pair being accessible only from the surface of said panel facing the exterior of said housing, upon mounting said panel thereon, said second rod pair being releasable from the exterior of said housing and serving as the latch portion of said latch and hinge assembly and said first rod pair being releasable from the interior of said housing only after release of said second rod pair, said first rod pair serving as the hinge portion of said assembly.

2. A luminaire as claimed in claim 1 wherein each of said luminaire housing walls defines holes therein at opposite ends thereof near said open end of said housing for receipt of said rods and wherein said housing is symmetrical, whereby said panel is mountable in the open end of said housing in various positions with respect thereto, thereby permitting the release of said second rod pair at a first predetermined wall of said housing to permit said panel to be pivoted about said first rod pair serving as the hinge portion of said latch end hinge assembly at an opposite wall of said housing.

3. A luminaire as claimed in claim 1 wherein said housing is square having four walls of equal length with adjoining walls being positioned at right angles with respect to each other and wherein each of said housing walls defines holes therein at opposite ends thereof near said open end of said housing for receipt of said rods whereby said panel is mountable in the open end of said housing in various predetermined positions with respect thereto.

4. A luminaire as claimed in claim 1 wherein both rods of said first rod pair are spring biased and include tabs for manually retracting said rods against said biasing force, both said tabs being accessible only from the surface of said panel facing the interior of said housing upon mounting said panel thereon.

5. A luminaire as claimed in claim 1 wherein said housing includes an even number of side walls equal in length with adjoining walls being positioned at predetermined angle with respect to each other, wherein each of said housing walls defines holes therein at opposite ends thereof near the open end of said housing for receipt of said rods, whereby said panel is mountable in the open end of said housing in various predetermined positions with respect thereto and wherein said first and second pairs of rods are mounted in walls of said frame of said panel which are parallel to each other and on opposite sides of said panel.

* * * * *